US005745147A

United States Patent [19]

Johnson et al.

[11] Patent Number: 5,745,147

[45] Date of Patent: Apr. 28, 1998

[54] RESISTANCE-STABLE THERMAL PRINT HEADS

[75] Inventors: David Andrew Johnson, Rochester; Gilbert Allan Hawkins, Mendon; James E. Elly, North Chili; John Alphonse Agostinelli, Rochester, all of N.Y.

[73] Assignee: Eastman Kodak Company, Rochester, N.Y.

[21] Appl. No.: 617,510

[22] Filed: Mar. 15, 1996

[51] Int. Cl.[6] ..... B41J 2/325; B41J 2/335

[52] U.S. Cl. ..... 347/200; 347/202; 347/203

[58] Field of Search ..... 347/200, 201, 347/202, 203, 205, 210, 208; 400/120.01

[56] References Cited

U.S. PATENT DOCUMENTS

| | | | |
|---|---|---|---|
| 3,931,492 | 1/1976 | Takano et al. | 347/203 |
| 4,651,164 | 3/1987 | Abe et al. | 347/210 |
| 5,418,553 | 5/1995 | Connolly | 347/200 |
| 5,444,475 | 8/1995 | Mitani | 347/200 |
| 5,623,298 | 4/1997 | Motoyama et al. | 347/202 |

*Primary Examiner*—Adolf Berhane
*Attorney, Agent, or Firm*—Raymond L. Owens

[57] ABSTRACT

A thermal print head which includes an array of individually addressable resistors on a substrate is provided to substantially reduce undesirable drift in the resistance values of the resistors. The thermal print head includes a thermally stable glaze having a smooth surface formed on the substrate, and an electrically resistive doped-semiconductive layer formed on the smooth glaze surface. An array of first and second electrode pairs is formed on the resistive layer such that each of the electrodes forms a gap therebetween. A protective layer is formed over the electrode pairs and over the resistive layer at the gap. An electrically conductive layer is formed on the protective layer. The thermal print head includes a structure for applying first and second potentials respectively to the first and second electrodes of each of the pairs for selectably heating each of the resistors, and applying a third potential to the conductive layer. The thermal print head further includes a structure for switching the potential of the first electrode from a low terminal potential state to a state substantially equal to the potential of the second electrode, and for providing the absolute value of the potential of the third electrode to be greater than the low terminal potential.

51 Claims, 11 Drawing Sheets

RESISTOR NUMBER

RESISTANCE-STABLE THERMAL PRINT HEADS

FIELD OF INVENTION

This invention relates to improved thermal print head devices having thin film resistors for heating, and more particularly to substantially reduced undesirable drift in the resistance values of the resistors which comprise the thermal print head devices.

BACKGROUND OF THE INVENTION

A thin film thermal print head for imaging applications commonly includes a linear array of thin film resistors mounted on a glass structure, called a partial glaze, which is constructed on a ceramic substrate. Thermal print heads commonly have resistor resolutions of 137 to 600 resistors per inch. The length of the resistor array for print heads commonly used for imaging applications is typically 3.5 inches to 12 inches.

The cross section of a prior art thin film thermal print head is shown in FIG. 1. A ceramic substrate 12 is typically mounted to an aluminum backer plate support structure 10 which can be easily attached to a heat sink to eliminate waste heat from the print head. The ceramic substrate 12 provides a durable heat resistant surface for construction of the print head. A glass partial glaze 14, typically 50 microns high and 1 millimeter wide at the base, provides a very smooth surface to deposit the thin film resistors. The partial glaze 14 is in the form of a linear bead protruding above the ceramic substrate 12. The bead is adapted to form a nip and allows higher nip pressures to be developed at the print head/media interface. The term "media" will be understood to include two component donor/receiver imaging materials, or single component imaging materials such as direct thermal paper or Fuji THERMO-AUTOCHROME. Dye donors or wax donors are typically constructed on a plastic support, such as polyethylene terephthalate. Receiver materials are typically constructed with a dye or wax receiving layer on a paper-based or plastic support. Higher nip pressure improves donor to receiver contact, allowing more consistent dye diffusion between the donor and receiver. A thin film resistive layer 16 is formed atop the partial glaze 14. The material of the resistive layer 16 is typically sputtered onto the surface of the partial glaze 14 to form thin film resistors. The thin film resistor is typically 0.5 microns thick, and can be constructed from a variety of materials, including titanium, $Ta_2N$, $TaSiO_2$, TaSiC, and doped polysilicon. Electrodes 18*a* and 18*b* provide current to the segment of the resistive layer 16 which is located at a gap 20 between the electrodes 18*a* and 18*b*. The electrodes 18*a* and 18*b* can be constructed from several different types of materials, Al or W being the most common, however, AlTi, Ti, Cr-Au, NiCr-Au, and Ni can also be employed. A contact metallization, for example, AuPdTi, can be used between the electrodes 18*a* and 18*b* and the resistive layer 16. The electrodes 18*a* and 18*b* are connected to a circuit means to selectably drive the resistors. A protective layer 22 protects the resistors from the environment and from abrasion and is usually 2 to 10 microns thick, depending on the material. The protective layer 22 is most frequently some type of silicon nitride material. Manufacturers typically have proprietary versions of silicon nitride coatings with special dopants added to modify material properties.

Inexpensive print heads can use a semiconductor, such as polysilicon, as a material for the resistive layer 16. The polysilicon is suitably doped to provide the appropriate resistivity. This type of inexpensive print head uses a protective layer which has been optimized to reduce damage from physical abrasion. The optimized abrasion-resistant protective layer is a doped Si oxynitride. Although the protective layer is very effective in reducing abrasion damage, the abrasion-resistant protective layer produces an undesirable effect. When the abrasion-resistant protective layer is used with the polysilicon material for the resistive layer 16, the resistance of the resistors varies with use of the print head and also varies imagewise with the image content. An electrically conductive layer, such as tungsten, is sometimes applied to the surface of the protective layer. This conductive layer is connected to electrical ground, typically through a 5 MΩ resistor, to suppress electrostatic discharge and subsequent damage to the print head as a result of moving imaging media past the print head during the printing process. The damage is caused by arcing through the protective layer associated with very high potentials, for example, kilovolts.

SUMMARY OF THE INVENTION

It is an object of the present invention to provide an improved thermal print head structure which can be adapted to reduce changes in resistance values of the resistors with operation of the print head.

It is also an object of the present invention to provide control of small potentials, for example, volts, across the protective layer.

These objects are achieved by a thermal print head, including an array of individually addressable resistors on a substrate and adapted to substantially reduce undesirable drift in the resistance values of the resistors, comprising:

a) a thermally stable glaze having a smooth surface formed on the substrate;

b) an electrically resistive doped-semiconductive layer formed on the smooth glaze surface;

c) an array of first and second electrode pairs formed on the resistive layer, each of the first and second electrodes forming a gap therebetween;

d) a protective layer formed over the first and second electrodes and over the resistive layer at the gap;

e) an electrically conductive layer formed on the protective layer;

f) means for applying first and second potentials respectively to the first and second electrodes of each of the pairs for selectably heating each of the resistors;

g) means for applying a third potential to the conductive layer;

h) means for switching the potential of the first electrode from a low terminal potential state to a state substantially equal to the potential of the second electrode; and i) means for providing the absolute value of the potential of the third electrode to be greater than the low terminal potential.

It is another object of the invention to provide a wear resistant layer having desirable wear resistant characteristics on the conductive layer wherein the potential of the conductive layer is controlled to reduce changes in resistance values of the resistors.

This object is achieved by a thermal print head, including an array of individually addressable resistors on a substrate and adapted to substantially reduce undesirable drift in the resistance values of the resistors, comprising:

a) a thermally stable glaze having a smooth surface formed on the substrate;

b) an electrically resistive doped-semiconductive layer formed on the smooth glaze surface;

c) an array of first and second electrode pairs formed on the resistive layer, each of the first and second electrodes forming a gap therebetween;

d) a protective layer formed over the first and second electrodes and over the resistive layer at the gap;

e) a conductive layer formed on the protective layer;

f) a wear resistant layer formed on the surface of the conductive layer;

g) means for applying first and second potentials respectively to the first and second electrodes;

h) means for applying a third potential to the conductive layer;

i) means for switching the potential of the first electrode from a low terminal potential state to a state substantially equal to the potential of the second electrode; and j) means for providing the absolute value of the potential of the third electrode to be greater than the low terminal potential.

Advantages

An advantage to the present invention is that by adjusting the potential at the surface of the protective layer of a thermal print head, the variation in resistance can be substantially reduced.

Another advantage to the present invention is to reduce sparking.

Another advantage to the present invention is to provide a thermal print head structure which will improve image quality.

DETAILED DESCRIPTION OF THE PREFERRED EMBODIMENTS

Figure 1:
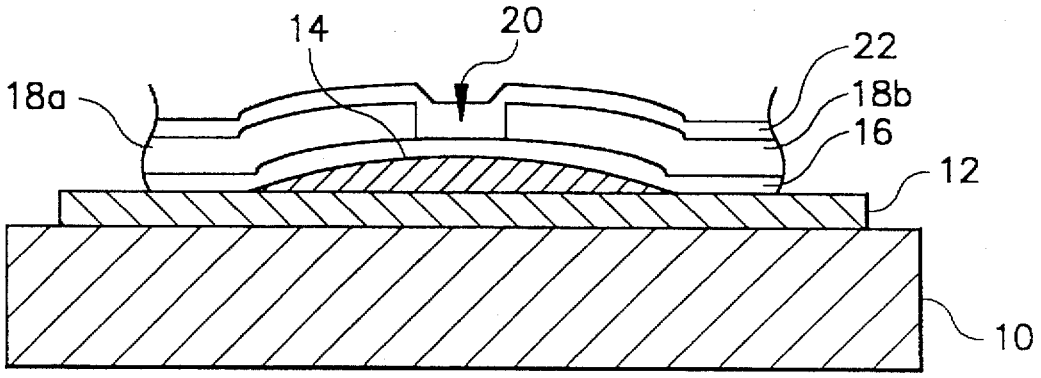
FIG. 1 (PRIOR ART)
FIG. 1 is a cross-sectional view of a prior art print head.
Figure 2:
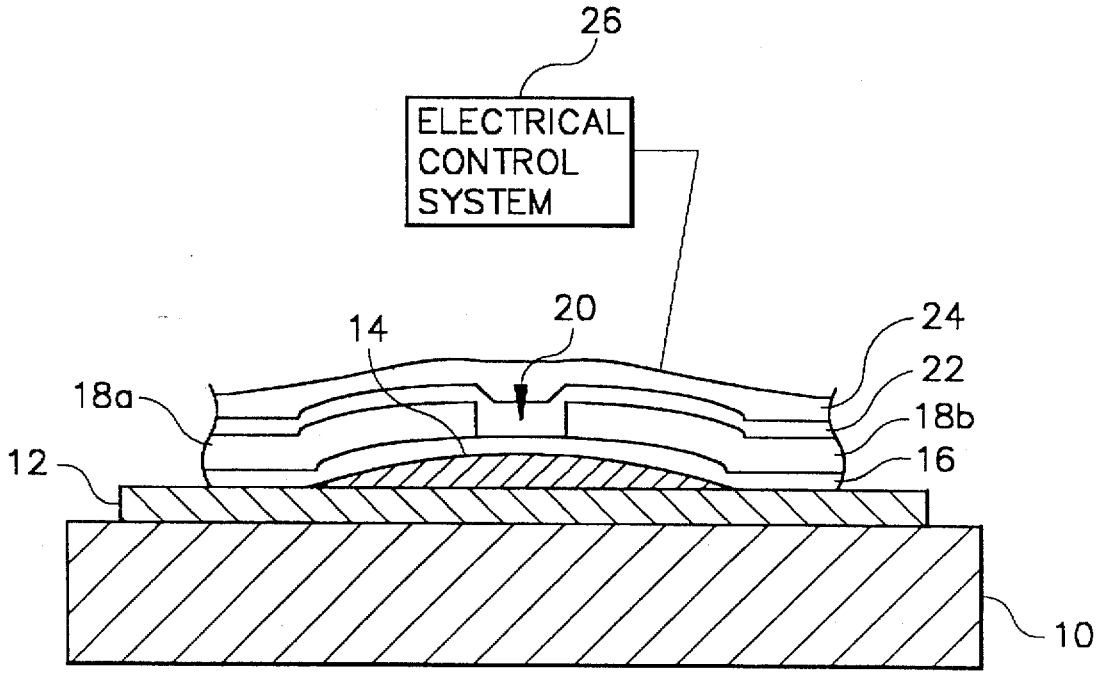
FIG. 2 is a cross-sectional view of a print head having a conductive layer in accordance with the present invention.

Extensive experimentation by the inventors has disclosed quite unexpectedly that the abrasion-resistant protective layer and polysilicon resistor print head configuration of the prior art form a system where the resistance of individual resistors is sensitive to electric potential differences between the surface of the protective layer and the underlying resistors, even for very small potentials, for example, volts. A significant portion of thermal imaging media is composed of plastic material which readily generate electrostatic charge. The motion of the media through the printer, as well as the friction of the media against another piece of identical media during the receiver picking or feeding process can generate large potentials on the surfaces of the materials, particularly when printing on a transparency receiver. These potentials can be measured using an electrostatic voltmeter. The large deposits of charge on the surfaces of the media generate significant electrostatic fields, which are moved past the print head during the printing process. Typically, a 6 micron thick donor web is sandwiched between the highly charged receiver and the print head. Thermal donor media is manufactured on a polyethylene terephthalate support and is also known to generate significant electrostatic charges while moving through the printer.

Where parts or elements correspond to FIG. 1, the same numerals will be used. Referring to FIG. 2, the cross section of a preferred thin film thermal print head in accordance with the present invention is shown. The ceramic substrate 12 is typically mounted to the aluminum backer plate support structure 10 which can be easily attached to a heat sink to eliminate waste heat from the print head. The ceramic substrate 12 provides a durable heat resistant surface for construction of the print head. The glass partial glaze 14, typically 50 microns high and 1 millimeter wide at the base, provides a very smooth surface to deposit the thin film resistors. The thermal conductivity of the partial glaze 14 is also used to control the flow of heat from the resistor into the ceramic substrate 12. In accordance with the present invention, the partial glaze 14 formed on the ceramic substrate 12 is in the form of a linear bead protruding above the ceramic substrate 12. The bead is adapted to form a nip and allows higher nip pressures to be developed at the print head/media interface. Higher nip pressure improves donor to receiver contact, allowing more consistent dye diffusion between the donor and receiver. Though the use of the partial glaze 14 is preferred, it is possible to construct a print head having a flat glaze. The thin film resistive layer 16 is formed atop the partial glaze 14. The material of the resistive layer 16 is typically sputtered onto the surface of the partial glaze 14 to form the thin film resistors. The thin film resistor is typically 0.5 microns thick, and can be constructed from a variety of materials including, titanium, $Ta_2N$, $TaSiO_2$, TaSiC, and doped polysilicon. The electrodes **18*a* and 18*b*, as shown in FIG. 2, provide current to the segment of the resistive layer 16 which is located at the gap 20, between the electrodes 18*a* and 18*b*. The electrodes 18*a* and 18*b* can be constructed from several different types of materials, Al or W being the most common. However other materials such as AlTi, Ti, Cr-Au, NiCr-Au, and Ni can also be employed. A contact metallization, for example, AuPdTi, can be used between the electrodes 18***a* and 18*b* and the material of the resistive layer 16. The electrodes 18*a* and 18*b* are connected to a circuit means to selectably drive the resistors. The protective layer 22 protects the resistors from the environment and from abrasion and is usually 2 to 10 microns thick, depending on the material. The protective layer 22 is most frequently some type of silicon nitride material. Manufacturers typically have proprietary versions of silicon nitride coatings with special dopants added to modify material properties. An electrically conductive layer 24, which functions as an electrode, is applied to the surface of the protective layer 22, and will be described in FIG. 3.

In the prior art, the conductive layer 24 is connected to electrical ground, typically through a 5 MΩ resistor, to provide a return path for electrostatic fields and discharge any electrical charge that is created at the surface or transferred to the surface of the print head as a result of moving imaging media past the print head. By connecting the conductive layer 24 to ground potential as in the prior art, all of the electromagnetic field lines would be expected to terminate in the conductive layer 24, and thus the conductive layer 24 should act as an effective electrostatic shield for the resistors. However, the polysilicon resistors with the abrasion-resistant protective layer, as in the prior art, proved quite unexpectedly to be sensitive to relatively small electrostatic fields across the protective layer thereby causing any electrostatic shielding provided by connection of conductive layer 24 to ground to be inadequate. A W conductive layer was applied to the abrasion-resistant protective layer, and the conductive layer was connected to electrical ground through a 5 MΩ resistor as in the prior art. However, large changes in resistance values of the resistors were still observed. These changes in resistance give rise to undesirable artifacts in the thermally generated images, such as streaking and other nonuniformities in image density.

Figure 3:
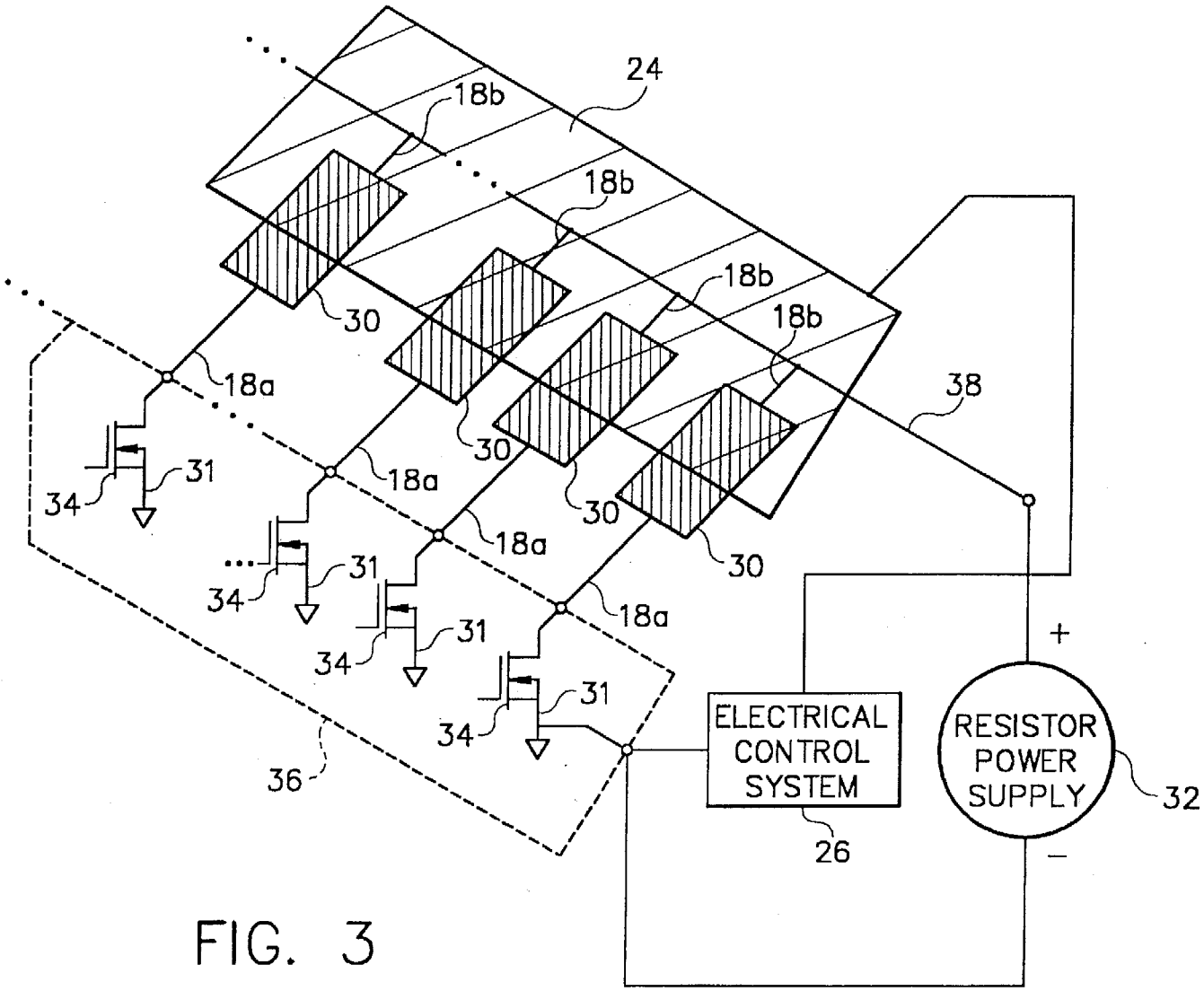
FIG. 3 is a schematic diagram of the electrical drive circuit used in accordance with the present invention.

Turning to FIG. 3, in an embodiment of the present invention, the conductive layer 24 is connected to an electrical control system 26 including a potential source preferably selected to achieve the minimum potential drop across the protective layer 22, as will be discussed below.

In the embodiment of FIG. 3, electrode 18*b*, at one end of resistor 30, is preferably connected to the positive common supply bus 38. The positive common supply bus 38 is usually connected to the positive side of a resistor power supply 32 which provides current to all the print head resistors 30. For each resistor 30 in the array, the electrode 18*a* is controlled by a switching element 34, typically an open drain N-channel power field effect transistor (FET) located in an integrated circuit (IC) 36, on the print head. It is to be noted that all potential values are measured with respect to a reference potential which is the potential of circuit point 31 of FIG. 3, typically ground potential, as is common in the art. For example, in FIG. 3, the value of the potential of electrode 18*a* on the side of the resistor 30 which is switched, is measured with respect to the reference potential. Similarly, the potential of electrode 18*b* on the side of the resistor 30 which is not switched, is measured with respect to the reference potential.

Again referring to FIG. 3, when switching element 34 is in the "on" state, a maximum current flows through resistor 30 and the value of the potential of electrode 18*a* is a low terminal potential, typically substantially the same as the reference potential. When switching element 34 is in the "off" state, a minimum current flows through resistor 30, and the potential of electrode 18*a* is a high terminal potential, typically substantially equal to the potential of electrode 18*b*. In the case that the polarity of the supply potential is reversed, the values of the low terminal potential and high terminal potential are taken to be their absolute values. It is to be appreciated that the particular reference potential chosen is immaterial in comparing differences in potentials at various places in circuits such as that shown in FIG. 3, as is well known in the art.

Again referring to FIG. 3, each IC 36 on the print head contains from 32 to 128 N-channel FET outputs (depending on the design of the IC), capable of driving 32 to 128 resistors. The switching element 34 provide a return path for the current from the resistor power supply 32 when the switching element 34 is turned ON. Thus, when an individual switching element 34 is turned ON, the drain-source resistance is $R_{dsON}$=70Ω (typical) and current flows from the resistor power supply 32 through a positive common supply bus 38, through the energized resistor 30, through the 70Ω $R_{dsON}$, and returns to the positive resistor power supply 32. The resistance of the resistor 30, including the output driver switch resistance $R_{dsON}$, can be measured by accurately measuring the current drawn from the resistor power supply 32 when only one resistor 30 is energized, and by measuring the potential of the resistor power supply 32, $V_R$. Knowing these two values, the resistance of the resistor 30 (ignoring $R_{dsON}$) can be calculated as: $R_{Resistor}=V_R/I_{Resistor}$.

$R_{dsON}$ can be ignored if high quality ICs are used which have very consistent resistance from driver to driver. By carefully turning ON each FET output driver individually, with a low resistor supply potential (3.0 Volts) to minimize resistor temperature change (self-heating), the resistance of each resistor in a linear array print head can be measured, in a way that does not substantially alter its resistance.

Figure 4:
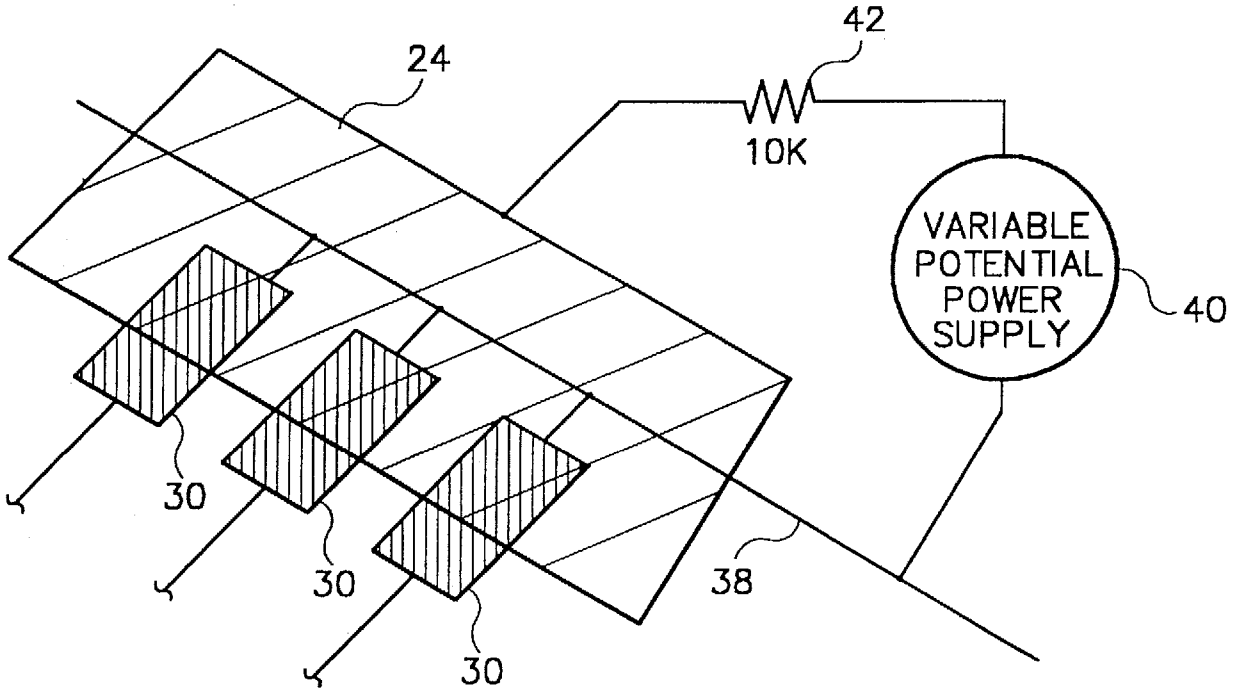
FIG. 4 shows the way by which low DC potentials were connected to the conductive layer on the print head.
Figure 5:
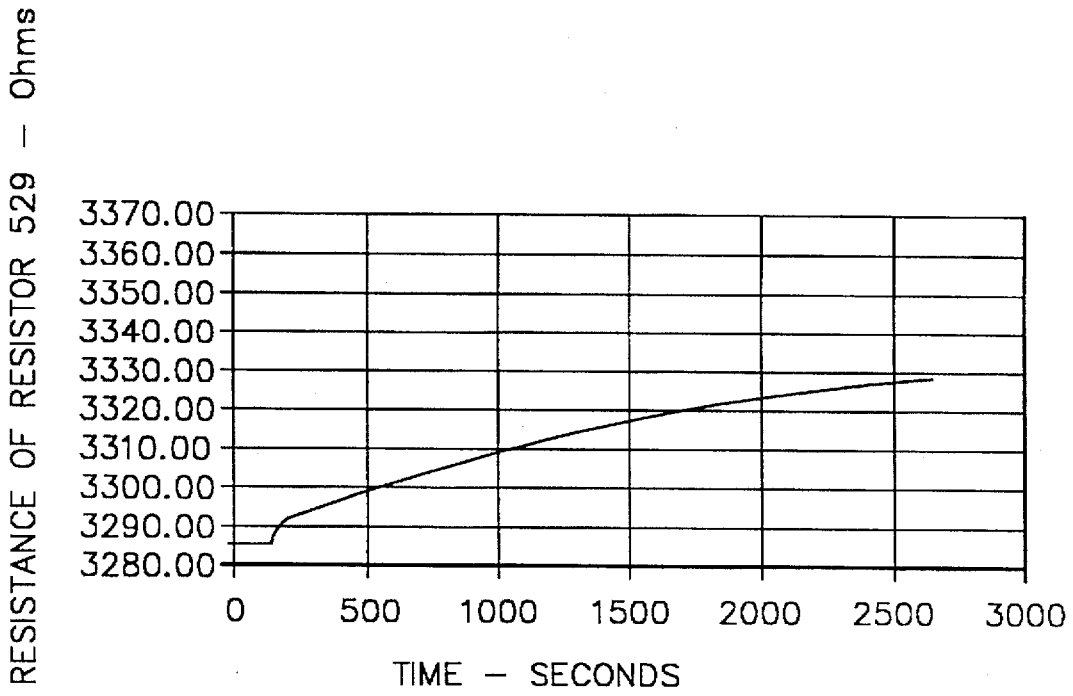
FIG. 5 shows the change in resistance of a resistor when +10 Volts DC was applied from the common electrode to the conductive layer.
Figure 6:
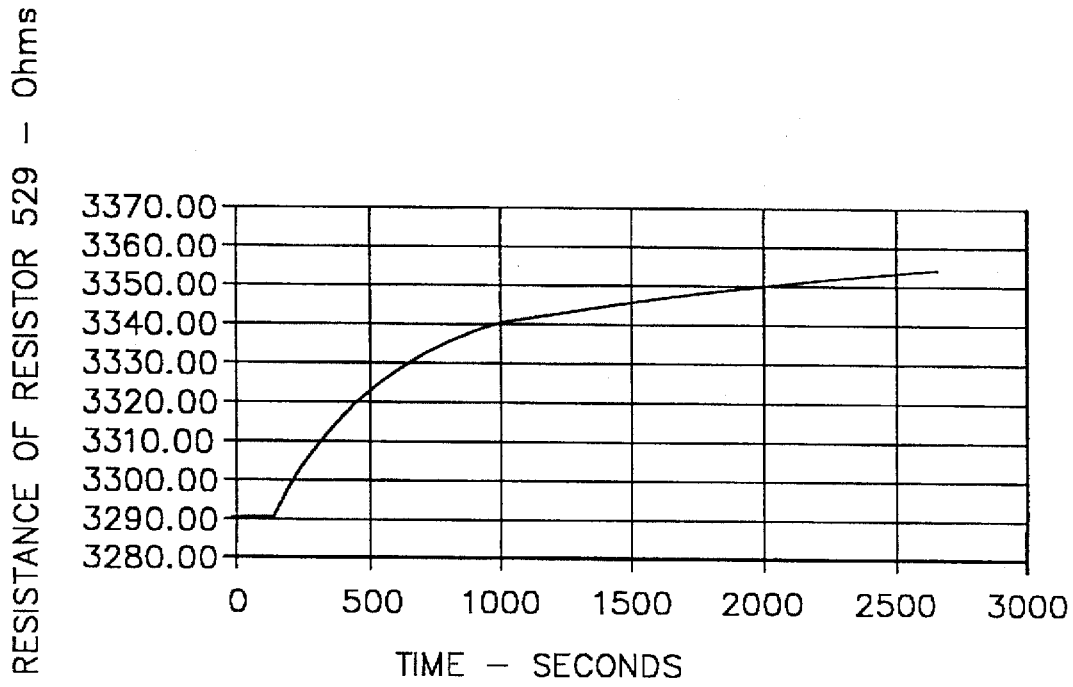
FIG. 6 shows the change in resistance of a resistor when +20 Volts was applied from the common electrode to the conductive layer.
Figure 7:
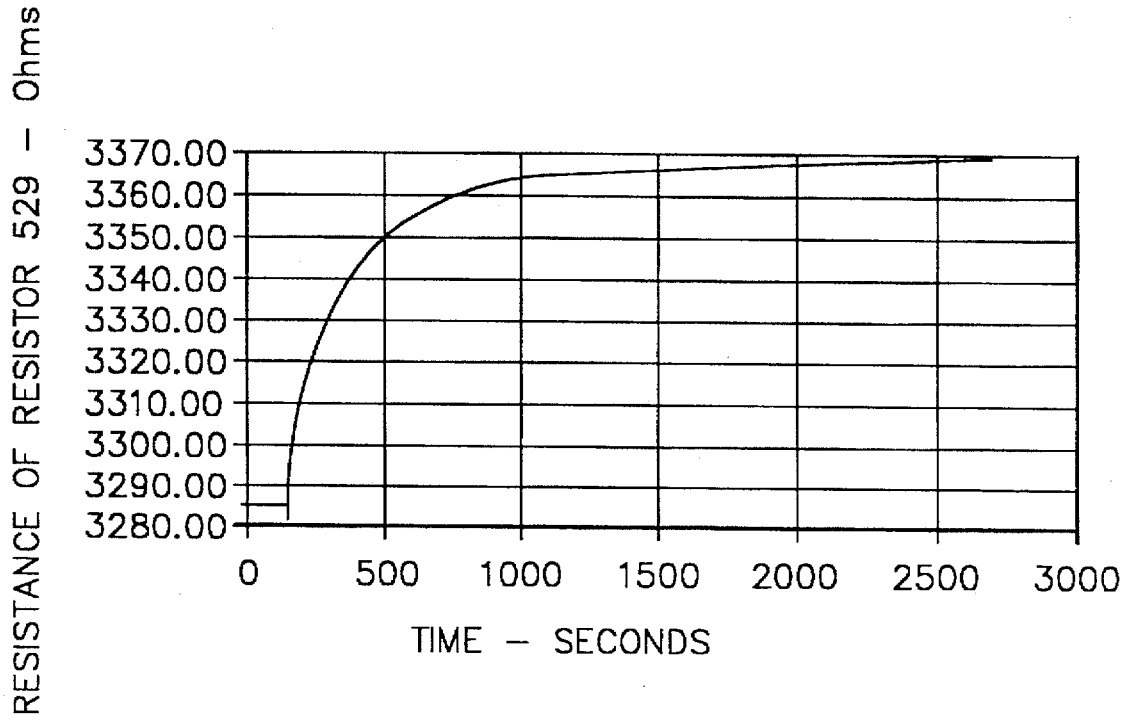
FIG. 7 shows the change in resistance of a resistor when +40 Volts was applied from the common electrode to the conductive layer.

Referring to FIGS. 5–7, significant resistance changes are observed for the application of small electrostatic potentials to the conductive layer 24. The measurements were made using a technique shown schematically in FIG. 4. A variable potential power supply 40 was connected through a 10KΩ resistor 42 to the conductive layer 24 as shown. The resistance of an individual resistor 30, $R_{Resistor}$, was measured as described above. The resistance of one resistor 30 in the print head was observed when different small potentials were applied to the conductive layer 24 to create an electrostatic field across the protective layer 22. FIG. 5 shows the resistance change with +10 Volts DC applied to the conductive layer 24 relative to the common supply bus 38. FIG. 6 and FIG. 7 show the resistance change with +20 Volts DC and +40 Volts DC, respectively, applied to the conductive layer 24. The observed resistance changes were not expected, nor desired.

Figure 8:
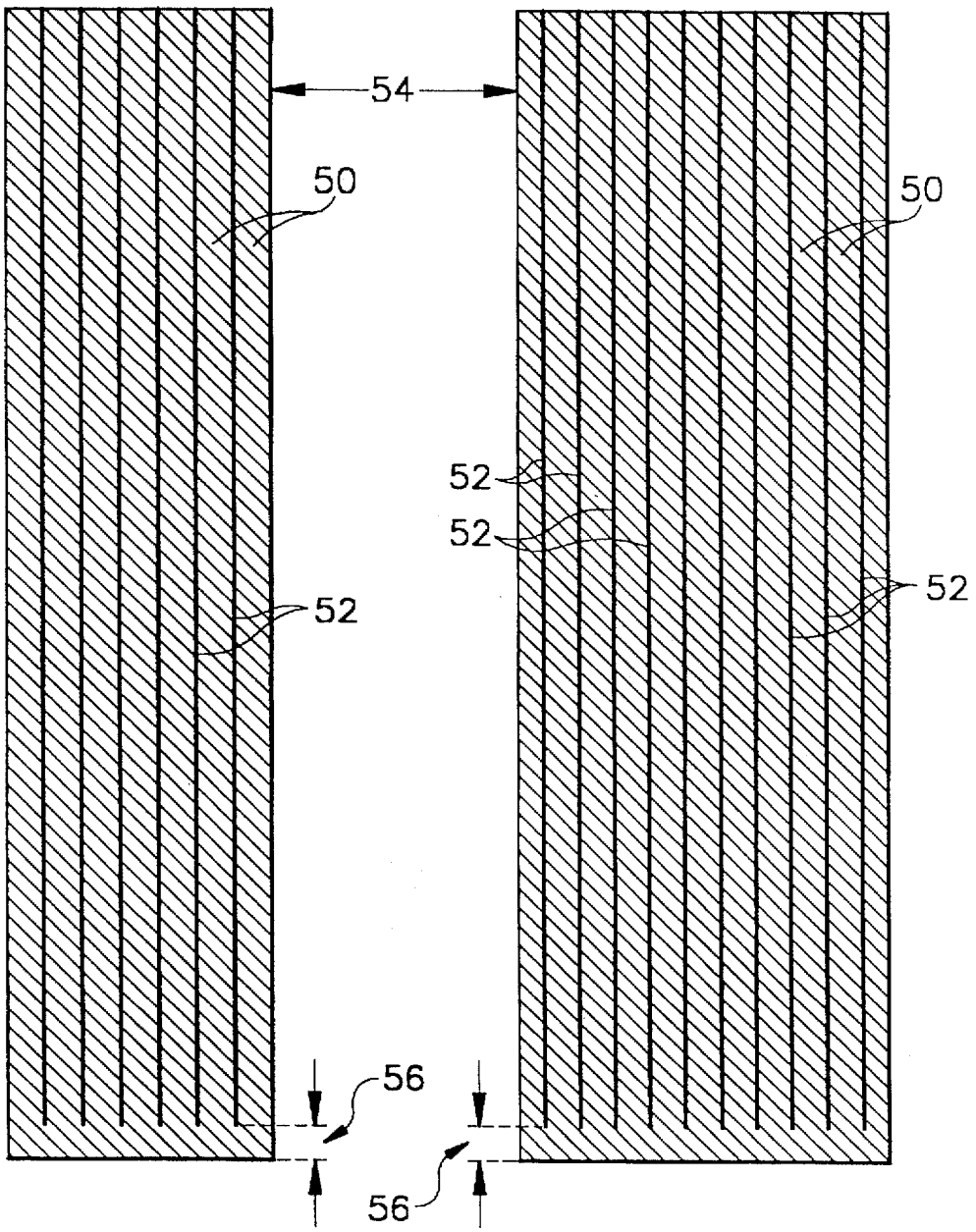
FIG. 8 is a diagram of the BARS image (later discussed)

A special test image was constructed to characterize the resistance variations of the resistor (referred to as the BARS image). FIG. 8 is a diagram of the BARS image. The BARS image consists of a low optical density (0.18 OD) background 50 with high density (1.8 OD) bars 52 located every 80 resistors. The bars 52 are 20 resistors wide. Each image pixel across the 8.5 inch page corresponds to the location of one resistor. The BARS image is typically printed on transparency receiver using a continuous tone dye transfer process. The BARS image is printed using 3 dye patches, yellow, magenta, and cyan to produce an image which is approximately neutral gray in color. Notice there is a region 54 that is 768 pixels wide, slightly offset from the center of the image, for which the corresponding 768 resistors are never energized while printing the BARS image. Any change in resistance of these 768 resistors is not related to energizing the resistors during the printing of the BARS image. FIG. 8 also shows there is a 6 millimeter region 56 near the end of the BARS image where the high density bars are not printed. Large changes in resistance can be observed in this 6 mm region. If the resistance of the resistors which have printed the high density bars has changed significantly relative to adjacent resistors which have printed the low density areas, the 6 mm area printed at the end of the page will not be a uniform low density area. Optical density variations, known as banding, will occur in the image, caused by the induced variations in resistance of the resistors. Quantitative characterization of resistance change is also relatively simple to obtain. The resistance of each resistor on the print head is measured before printing any images. Three of the BARS images are printed (a total of 9 dye patches). The resistance of the resistors is again measured. The change in resistance is calculated for each resistor by subtracting the initial resistance of each resistor from the resistance measured after 3 BARS images have been printed. The change in resistance is plotted.

Figure 9:
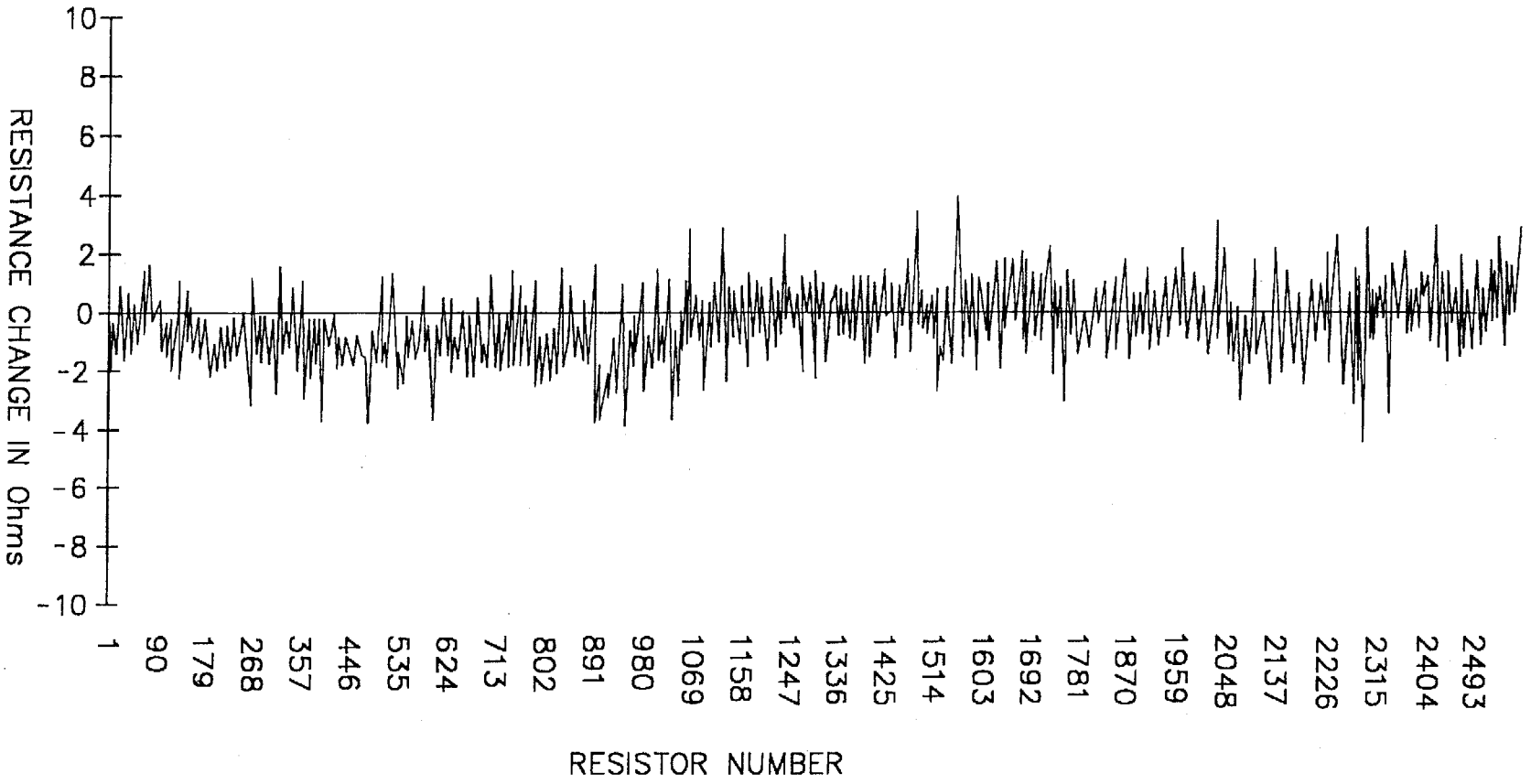
FIG. 9 shows the typical change in resistance of an array of resistors for a print head with a metallic resistor construction.

FIG. 9 is a plot of resistance change after printing three BARS images versus resistor number for a print head whose resistive layer is a metal. This print head is seen to be very stable in resistance values with a resistance variation of less than about 2Ω.

Figure 10:
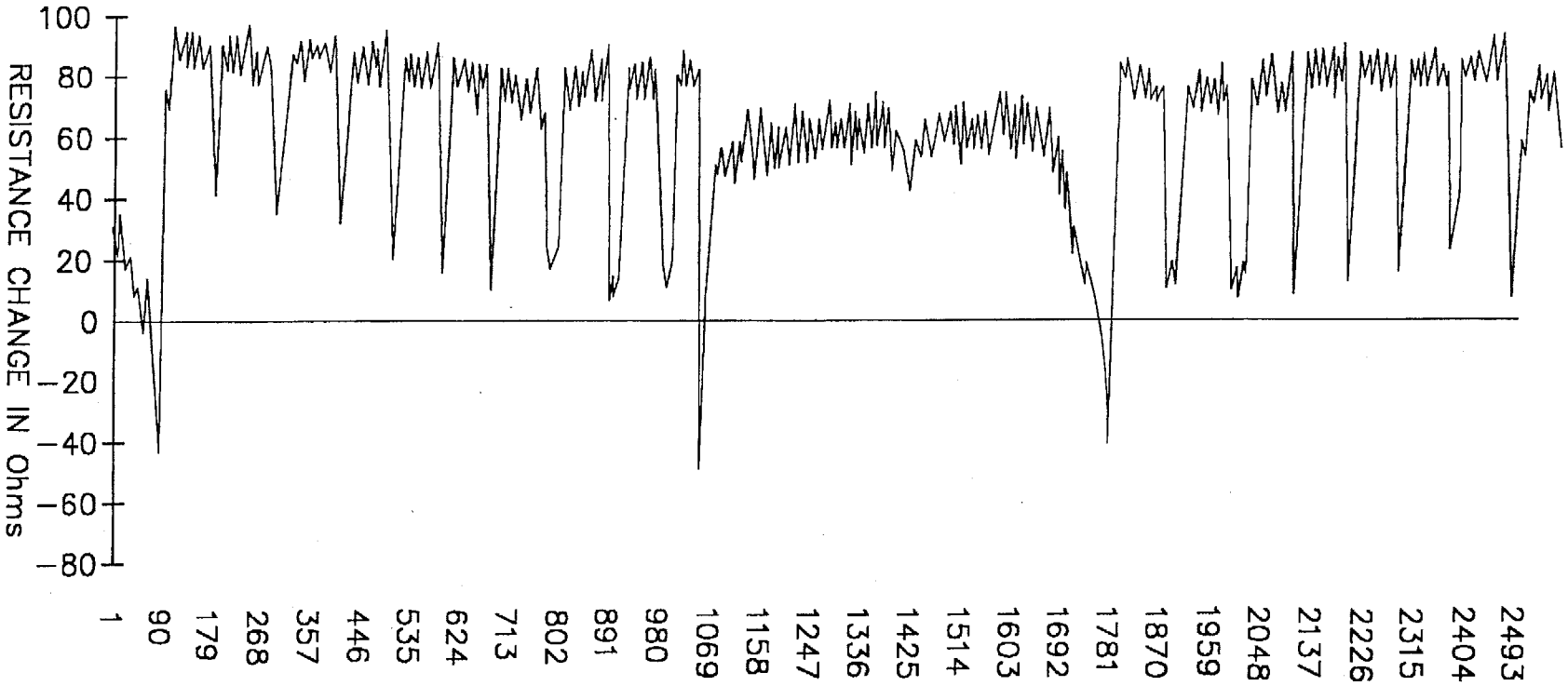
FIG. 10 (PRIOR ART)
FIG. 10 shows the typical change in resistance of an array of polysilicon resistors for a prior art print head with the abrasion-resistant protective layer and having no conductive layer.
Figure 11:
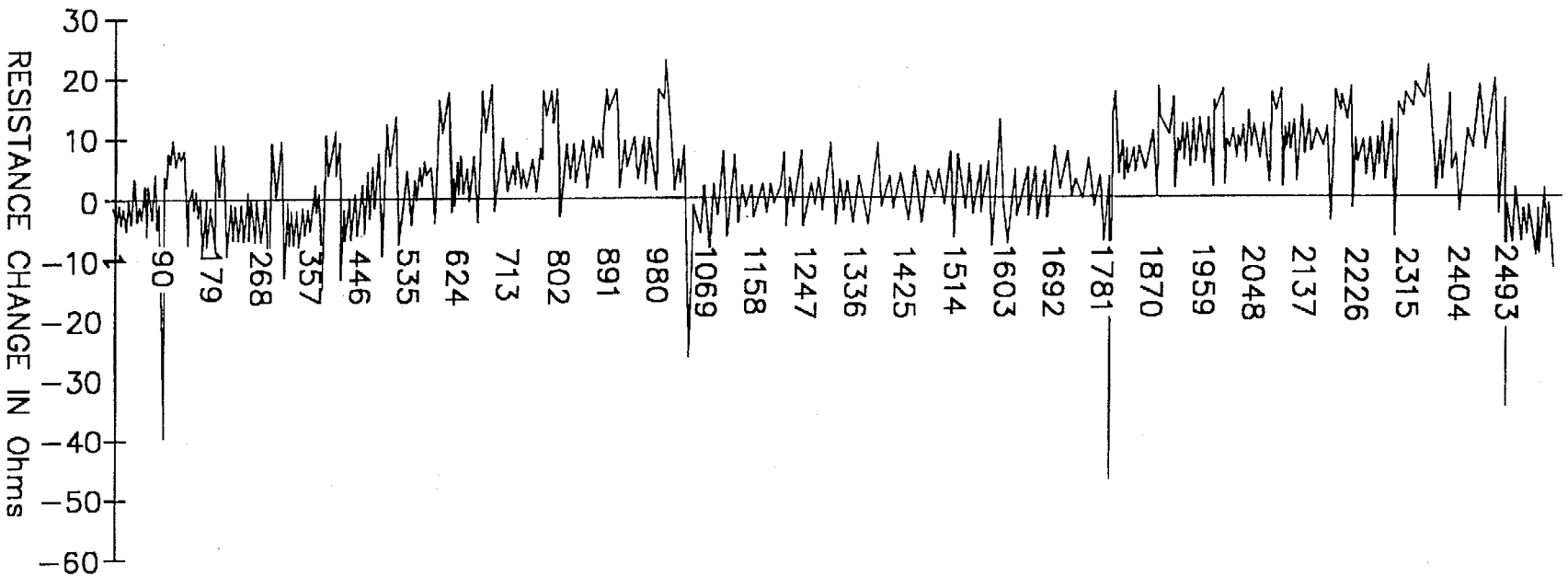
FIG. 11 (PRIOR ART)
FIG. 11 shows the typical change in resistance of an array of polysilicon resistors for a prior art print head with the abrasion-resistant protective layer, where the print head was energized, but no media was moved past the print head.
Figure 12:
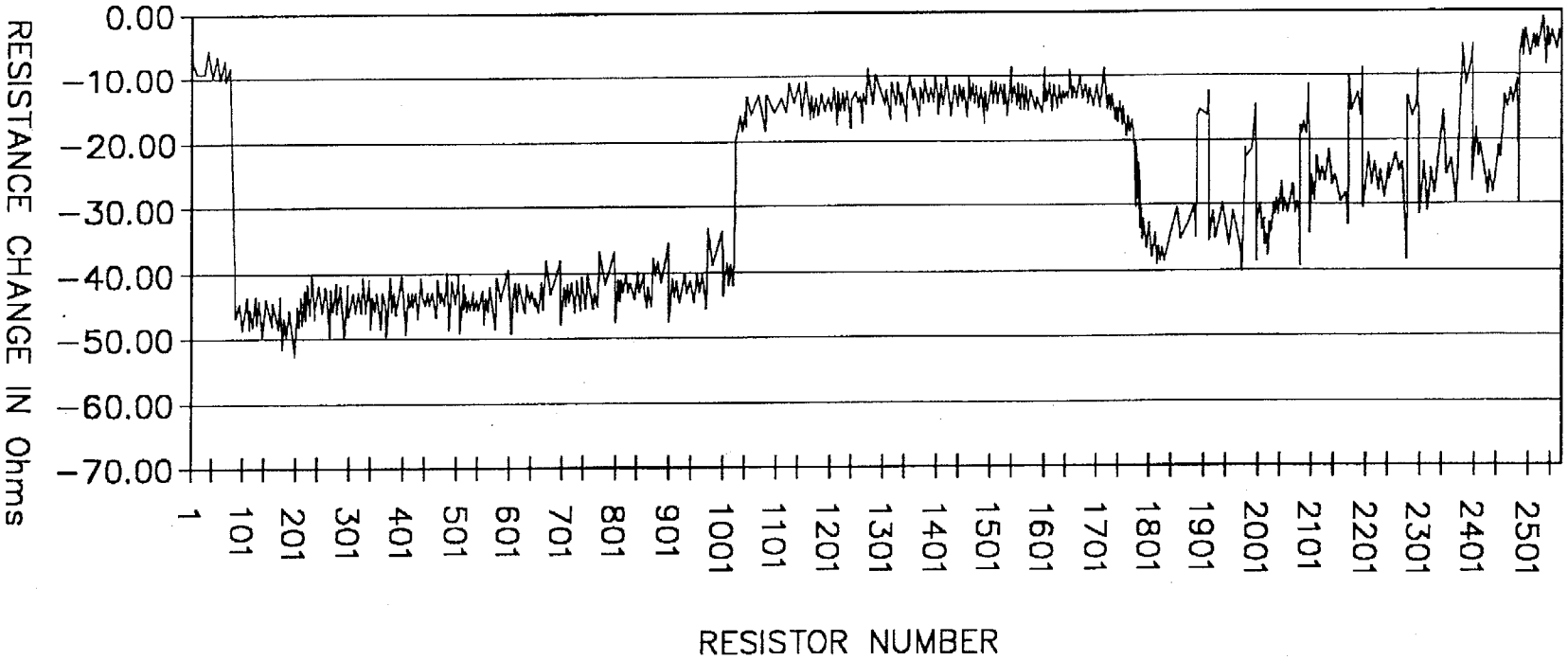
FIG. 12 (PRIOR ART)
FIG. 12 shows the typical change in resistance of an array of polysilicon resistors for a prior art print head with the abrasion-resistant protective layer, and a conductive layer connected to electrical ground through a 5 MΩ resistor.
Figure 13:
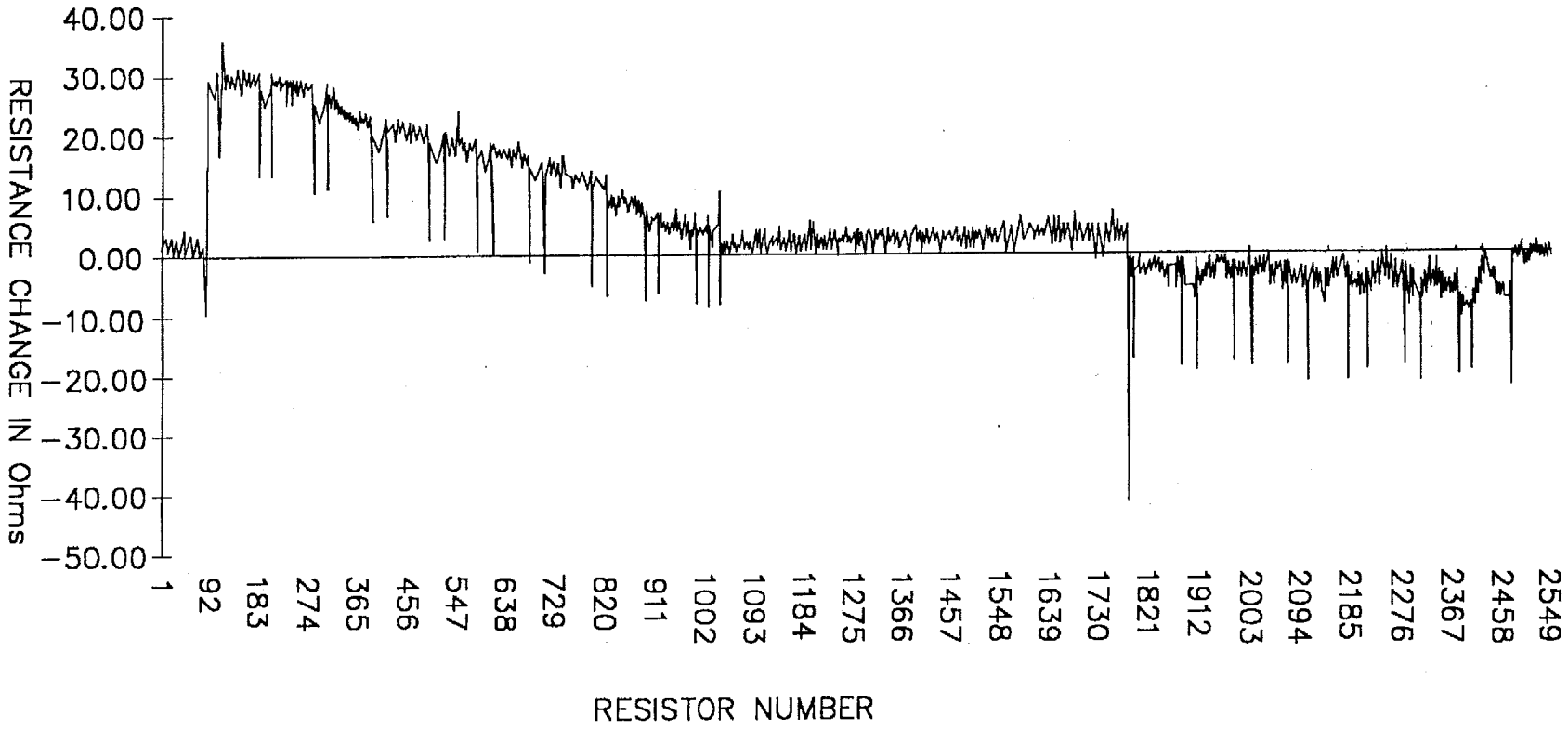
FIG. 13 shows the typical change in resistance of an array of polysilicon resistors for a print head with the abrasion-resistant protective layer, and a conductive layer connected directly to the positive common supply bus.

FIG. 11 shows the resistance change where the prior art polysilicon print head having no conductive layer is driven as if to print three BARS images but no media were in contact with the print head and therefore no media-produced electrostatic field was applied. FIG. 10 shows the resistance change for the same print head after printing three BARS images on media. Comparing FIG. 11 to FIG. 10 indicates that the resistance of each resistor varies much less significantly without contact with media. It is thought that the resistance change is attributable to an electrostatic field associated with contact to the media. For FIG. 11, since imaging media were not present to absorb energy from the resistors, the power applied to the print head was reduced by 10% to maintain the same resistor operating temperatures observed during normal image printing. Resistor variation in FIG. 11 is typically less than 10Ω. In FIG. 10 the resistance variation is 30 to 90Ω. Also, the 768 resistors which were not powered show a typical resistance variation of approximately 40Ω. FIG. 12 shows the typical change in resistance of an array of resistors for a prior art print head with the abrasion-resistant protective layer, a conductive layer connected to electrical ground through a 5 MΩ resistor, and polysilicon resistors. As shown in FIG. 12, the addition of the grounded conductive layer alters the resistance variation characteristics, but the resistance variation remains larger than desired. FIG. 13 shows the resistance changes for the print head in accordance with the present invention having a conductive layer 24 connected to the positive common supply bus 38. Comparing FIG. 13 to FIG. 10 shows a 10 to 60Ω reduction in the resistance variation due to the connection of the conductive layer 24 to the positive common supply bus 38, instead of the ground terminal (through a 5 MΩ resistor). In FIG. 13, notice the 768 resistors which were not powered show a typical resistance variation of approximately 2Ω.

Connecting the conductive layer 24 to the positive common supply bus 38, rather than the electrical ground, lowers the electrostatic field within the protective layer 22 by significantly reducing the potential difference across the protective layer 22. Before the creation of the low cost print head design using the abrasion-resistant protective layer with polysilicon resistors, the sensitivity of the polysilicon resistors to variation when low potentials were applied across the protective layer did not exist. One aspect of the present invention, connecting the conductive layer 24 to the positive common supply bus 38, was not obvious because previous designs did not show a significant sensitivity to low potentials applied across the protective layer 22. The connection of the conductive layer 24 to the positive common supply bus 38 therefore provides a more effective means of resistance variation suppression.

Preferred values for the potential of the conductive layer 24 may not be the positive common supply bus 38, depending on the overall duty cycle of the resistors. Assuming the overall duty cycle of the resistors was 100%, meaning that they are always on, the optimum potential source is $V_R/2$ since the average potential of the resistor is $V_R/2$ and the potential difference across the protective layer 22 above the gap 20 is minimum at $V_R/2$. During normal printing operation, the resistors are OFF the majority of the time, so the preferred conductive layer potential is much closer to $V_R$ in order to minimize the potential difference across the protective layer 22. The optimal value of the conductive layer potential is achieved by applying a potential to the conductive layer 24 which is equal to the time and space averaged resistor potential.

In some situations it is desirable to break the conductive layer 24 into an array of independently addressable electrodes so that it would be possible to provide different potentials to each electrode to minimize the resistance variation in different portions of the print head.

Materials for the conductive layer 24 for the purposes of the present invention include wear resistant chemically stable metals such as W, Ta, Ti, Cr, Ni and Mo. Electrically conductive metal nitrides, carbides, borides and silicides form classes of preferred electrically conductive wear resistant materials for the conductive layer. Particularly preferred examples include TiN, $CrB_2$, tungsten carbide, and MoSi. Conductive oxides form another class of preferred conductive layer materials with indium tin oxide and tin oxide being particularly preferred examples. Diamond-like carbon coatings form another useful category of materials for the conductive layer.

Figure 14:
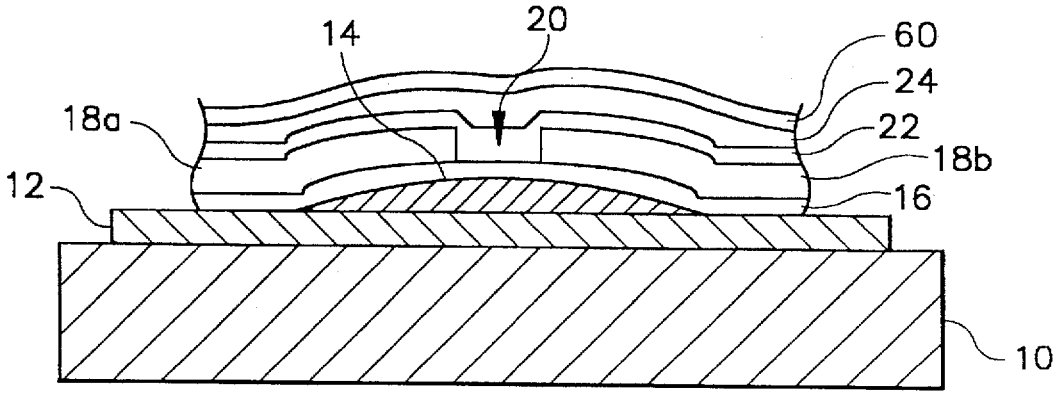
FIG. 14 shows a cross sectional view of a print head structure in accordance with this invention having a conductive layer and a wear resistant layer located atop a protective layer.

Referring to FIG. 14, a cross section of a print head having the conductive layer 24 with a wear resistant layer 60 is shown. To improve durability of the conductive layer 24, an additional wear resistant layer 60 can be used to protect the conductive layer 24. The additional wear resistant layer 60 would be applied on top of the conductive layer 24. The wear resistant layer 60 would be the mechanical interface which is pressed against the media. Preferred materials for the wear resistant layer 60 exhibit high hardness values and low coefficients of friction, have thermal expansion coefficients that are near to that of the underlying print head, and can be deposited economically. Many metal oxides, nitrides, carbides, and borides can form suitable wear resistant layers including $Al_2O_3$, Y stabilized zirconium oxide, $Si_3N_4$, BN, TiN, SiC, and tungsten carbide. Diamond and diamond-like carbon are also useful wear resistant materials. A particularly preferred material choice for the print head embodiment shown in FIG. 14 would make the conductive layer 24 the same material as the electrodes 18*a* and 18*b* and the wear resistant layer 60 the same material as the protective layer 22, or a simple to achieve modification thereof. Excellent examples of material choices would be Al for the electrodes 18*a* and 18*b* and the conductive layer 24 and doped Si oxynitride for the protective layer 22 and the wear resistant layer 60.

The print head embodiment shown in FIG. 14 will show substantial reduction in undesirable resistance variations when the conductive layer 24 is driven by a potential source set to a potential as described above.

The invention has been described in detail with particular reference to a certain preferred embodiment thereof, but it will be understood that variations and modifications can be effected within the spirit and scope of the invention.

PARTS LIST

| | |
|---|---|
| 10 | aluminum backer plate |
| 12 | ceramic substrate |
| 14 | partial glaze |
| 16 | resistive layer |
| 18a | electrode |
| 18b | electrode |
| 20 | gap |
| 22 | protective layer |
| 24 | conductive layer |
| 26 | electrical control system |
| 30 | resistor |
| 31 | circuit point |
| 32 | resistor power supply |
| 34 | switching element |
| 36 | integrated circuit |
| 38 | positive common supply bus |
| 40 | variable potential power supply |
| 42 | resistor |
| 50 | low optical density background |
| 52 | high density bars |
| 54 | region |
| 56 | region |
| 60 | wear resistant layer |

We claim:

1. A thermal print head, including an array of individually addressable resistors on a substrate and adapted to substantially reduce undesirable drift in the resistance values of the resistors, comprising:

a) a thermally stable glaze having a smooth surface formed on the substrate;

b) an electrically resistive doped-semiconductive layer formed on the smooth glaze surface;

c) an array of first and second electrode pairs formed on the resistive layer, each of the first and second electrodes forming a gap therebetween;

d) a protective layer formed over the first and second electrodes and over the resistive layer at the gap;

e) a conductive layer formed on the protective layer; and f) a wear resistant layer formed on the surface of the conductive layer.

2. The print head of claim 1 further including a thermally conductive support structure and wherein the substrate is mounted on the thermally conductive support structure.

3. The print head of claim 1 wherein the substrate is an electrically insulative thermally stable ceramic material.

4. The print head of claim 1 wherein the glaze is selected from the group consisting of glass and $Al_2O_3$.

5. The print head of claim 1 which is operatively associated with media and wherein the glaze is in the form of a linear bead protruding above the substrate, the bead being adapted to form a nip between the wear resistant layer and the media.

6. The print head of claim 1 wherein the doped-semiconductor includes doped-polysilicon.

7. The print head of claim 1 wherein the first and second electrodes are formed of a metal selected from the group consisting of Al, AlTi, Ti, Cr-Au, NiCr-Au, Ni, and W.

8. The print head of claim 1 wherein the second electrodes from each of the pairs are connected together to thereby form a common second electrode.

9. The print head of claim 1 wherein the protective layer includes doped-silicon oxynitride.

10. The print head of claim 1 wherein the conductive layer is formed of a metal selected from the group consisting of Al, AlTi, Ti, Cr-Au, NiCr-Au, Ni, and W.

11. The print head of claim I wherein the conductive layer is formed of a material substantially the same as the first and second electrodes.

12. The print head of claim 1 wherein the wear resistant layer is formed of a material selected from the group consisting of metal oxides, nitrides, carbides, borides, diamond-like carbon, diamond, Si oxynitride, and doped-Si oxynitride.

13. The print head of claim 1 wherein the wear resistant layer is formed of a material substantially the same as the protective layer.

14. The print head of claim 1 wherein an array of independently addressable third electrodes is formed in the conductive layer.

15. A thermal print head, including an array of individually addressable resistors on a substrate and adapted to substantially reduce undesirable drift in the resistance values of the resistors, comprising:

a) a thermally stable glaze having a smooth surface formed on the substrate;

b) an electrically resistive doped-semiconductive layer formed on the smooth glaze surface;

c) an array of first and second electrode pairs formed on the resistive layer, each of the first and second electrodes forming a gap therebetween;

d) a protective layer formed over the first and second electrodes and over the resistive layer at the gap;

e) an electrically conductive layer formed on the protective layer;

f) means for applying first and second potentials respectively to the first and second electrodes of each of the pairs for selectably heating each of the resistors;

g) means for applying a third potential to the conductive layer;

h) means for switching the potential of the first electrode from a low terminal potential state to a state substantially equal to the potential of the second electrode; and i) means for providing the absolute value of the potential of the third electrode to be greater than the low terminal potential.

16. The print head of claim 15 further including a thermally conductive support structure and wherein the substrate is mounted on the thermally conductive support structure.

17. The print head of claim 15 wherein the substrate is an electrically insulative thermally stable ceramic material.

18. The print head of claim 15 wherein the glaze is selected from the group consisting of glass and $Al_2O_3$.

19. The print head of claim 15 which is operatively associated with media and wherein the glaze is in the form of a linear bead protruding above the substrate, the bead being adapted to form a nip between the electrically conductive layer and the media.

20. The print head of claim 15 wherein the doped-semiconductor includes doped-polysilicon.

21. The print head of claim 15 wherein the first and second electrodes are formed of a metal selected from the group consisting of Al, AlTi, Ti, Cr-Au, NiCr-Au, Ni, and W.

22. The print head of claim 15 wherein the protective layer includes doped-silicon oxynitride.

23. The print head of claim 15 wherein the conductive layer includes a conducting metal nitride.

24. The print head of claim 15 wherein the conductive layer includes a conducting metal carbide.

25. The print head of claim 15 wherein the conductive layer includes a conducting metal boride.

26. The print head of claim 15 wherein the conductive layer includes a conducting metal silicide.

27. The print head of claim 15 wherein the conductive layer includes a conducting metal oxide.

28. The print head of claim 15 wherein the conductive layer includes a metal.

29. The print head of claim 15 wherein the conductive layer is selected from the group consisting of TiN, $CrB_2$, tungsten carbide, MoSi, Indium Tin Oxide, Tin Oxide, diamond-like carbon, Ni, Cr, Ti, Mo, Ta, and W.

30. The print head of claim 15 wherein the second electrodes from each of the pairs are connected together to thereby form a common second electrode.

31. The print head of claim 15 wherein the conductive layer is held at a potential substantially equal to the second electrode potential.

32. The print head of claim 15 wherein the conductive layer is held at a potential substantially equal to a time averaged resistor potential.

33. The print head of claim 15 wherein the conductive layer is held at a potential substantially equal to a spatially averaged resistor potential.

34. The print head of claim 15 wherein an array of independently addressable third electrodes is formed in the conductive layer.

35. A thermal print head, including an array of individually addressable resistors on a substrate and adapted to substantially reduce undesirable drift in the resistance values of the resistors, comprising:

a) a thermally stable glaze having a smooth surface formed on the substrate;

b) an electrically resistive doped-semiconductive layer formed on the smooth glaze surface;

c) an array of first and second electrode pairs formed on the resistive layer, each of the first and second electrodes forming a gap therebetween;

d) a protective layer formed over the first and second electrodes and over the resistive layer at the gap;

e) a conductive layer formed on the protective layer;

f) a wear resistant layer formed on the surface of the conductive layer;

g) means for applying first and second potentials respectively to the first and second electrodes;

h) means for applying a third potential to the conductive layer;

i) means for switching the potential of the first electrode from a low terminal potential state to a state substantially equal to the potential of the second electrode; and j) means for providing the absolute value of the potential of the third electrode to be greater than the low terminal potential.

36. The thermal print head of claim 35 further including a thermally conductive support structure and wherein the substrate is mounted on the thermally conductive support structure.

37. The print head of claim 35 wherein the substrate is an electrically insulative thermally stable ceramic material.

38. The print head of claim 35 wherein the glaze is selected from the group consisting of glass and $Al_2O_3$.

39. The print head of claim 35 which is operatively associated with media and wherein the glaze is in the form of a linear bead protruding above the substrate, the bead being adapted to form a nip between the wear resistant layer and the media.

40. The print head of claim 35 wherein the doped-semiconductor includes doped-polysilicon.

41. The print head of claim 35 wherein the first and second electrodes are formed of a metal selected from the group consisting of Al, AlTi, Ti, Cr-Au, NiCr-Au, Ni, and W.

42. The print head of claim 35 wherein the protective layer includes doped-silicon oxynitride.

43. The print head of claim 35 wherein the conductive layer is formed of a metal selected from the group consisting of Al, AlTi, Ti, Cr-Au, NiCr-Au, Ni, and W.

44. The print head of claim 35 wherein the conductive layer is formed of a material substantially the same as the first and second electrodes.

45. The print head of claim 35 wherein the wear resistant layer is formed of a material selected from the group consisting of metal oxides, nitrides, carbides, borides, diamond-like carbon, diamond, Si oxynitride, and doped-Si oxynitride.

46. The print head of claim 35 wherein the wear resistant layer is formed of a material substantially the same as the protective layer.

47. The print head of claim 35 wherein the second electrodes from each of the pairs are connected together to thereby form a common second electrode.

48. The print head of claim 35 wherein the conductive layer is held at a potential substantially equal to the second electrode potential.

49. The print head of claim 35 wherein the conductive layer is held at a potential substantially equal to a time averaged resistor potential.

50. The print head of claim 35 wherein the conductive layer is held at a potential substantially equal to a spatially averaged resistor potential.

51. The print head of claim 35 wherein an array of independently addressable third electrodes is formed in the conductive layer.

* * * * *

UNITED STATES PATENT AND TRADEMARK OFFICE

CERTIFICATE OF CORRECTION

PATENT NO. : 5,745,147
DATED : April 28, 1998
INVENTOR(S) : Johnson, et al

It is certified that error appears in the above-identified patent and that said Letters Patent is hereby corrected as shown below:

Title page, insert the following item:
--[60] Provisional application No. 60/001,131, July 13, 1995. –

Column 1, line 4, insert the following:
--CROSS REFERENCE TO RELATED APPLICATION
Reference is made to and priority claimed from U. S. Provisional Application Serial No. 60/001,131, filed July 13, 1995, entitled Resistance-Stable Thermal print Heads. --

Signed and Sealed this

Twenty-third Day of February, 1999

*Attest:*

Q. TODD DICKINSON

*Attesting Officer*

*Acting Commissioner of Patents and Trademarks*